United States Patent [19]

Polidori et al.

[11] Patent Number: 4,747,446

[45] Date of Patent: May 31, 1988

[54] WATER BOX AND EXPANSION CHAMBER DEVICE FOR A HEAT EXCHANGER

[75] Inventors: Roberto Polidori; Marco Broglio, both of Santena, Italy

[73] Assignee: Valeo, Paris, France

[21] Appl. No.: 919,030

[22] Filed: Oct. 15, 1986

[30] Foreign Application Priority Data

Oct. 15, 1985 [FR] France ..... 85 15275

[51] Int. Cl.[4] ..... F28D 13/00

[52] U.S. Cl. ..... 165/104.32; 123/41.51; 123/41.54; 165/917

[58] Field of Search ..... 165/104.32, 917; 123/41.51, 41.54

[56] References Cited

U.S. PATENT DOCUMENTS

| | | | |
|---|---|---|---|
| 4,116,268 | 9/1978 | Kruger | 123/41.54 |
| 4,512,396 | 4/1985 | Villeval | 165/104.32 |
| 4,580,622 | 4/1986 | Sigonneau | 165/104.32 |

FOREIGN PATENT DOCUMENTS

| | | |
|---|---|---|
| 0029373 | 5/1981 | European Pat. Off. . |
| 2506001 | 11/1982 | France . |
| 2514484 | 4/1983 | France . |
| 2532740 | 3/1984 | France . |
| 2483798 | 12/1987 | France . |

*Primary Examiner*—Albert W. Davis, Jr.

*Attorney, Agent, or Firm*—Dennison, Meserole, Pollack & Scheiner

[57] ABSTRACT

An integrally molded water box (36) and expansion chamber (38) device having a water box (36) with a middle partition (40) dividing it into two compartments, with a liquid inlet fitting (44) opening into the top compartment and a liquid outlet fitting (46) opening out into the bottom compartment. The inlet fitting (44) is located adjacent to the middle partition (40) and is connected to the expansion chamber via an orifice (48) through a wall (50) separating the expansion chamber from the water box, said orifice forming a liquid degassing passage. The invention is applicable to motor vehicle radiators.

7 Claims, 2 Drawing Sheets

WATER BOX AND EXPANSION CHAMBER DEVICE FOR A HEAT EXCHANGER

The invention relates to a water box and expansion chamber device for a heat exchanger, e.g. the radiator in the cooling circuit of an internal combustion engine, with the water box and the expansion chamber constituting a one-piece molded assembly.

BACKGROUND OF THE INVENTION

It is already known for such a one-piece device to inlude a degassing passage for degassing the liquid flowing through the heat exchanger, in order to prevent bubbles of air or gas conveyed by the liquid from collecting at various points in the engine cylinder head and thus forming hot spots.

When the water box is disposed generally vertically, bubbles of air or gas conveyed by the engine cooling liquid tend to collect in the top of the water box. For degassing, a tube is provided which is fixed, for example, to the water box and which puts the top end of the water box into communication with the expansion chamber by opening out into the expansion chamber below the level of the liquid which is contained therein in normal operation, in order to avoid air being sucked back into the cooling circuit when the engine is switched off. This tube is inconvenient to install and fix in place, and as a result it increases the most of the heat exchanger.

Preferred embodiments of the present invention avoid this drawback while ensuring that the cooling liquid is still properly degassed.

SUMMARY OF THE INVENTION

The present invention provides a water box and expansion chamber device for a heat exchanger, such as a radiator in a cooling circuit for an internal combustion engine, in which the water box and the expansion chamber constitute a one-piece molded assembly, with the water box being disposed in a generally vertical position and including an internal partition dividing it into a top compartment and a bottom compartment, the top compartment having a liquid inlet fitting opening out therein and the bottom compartment having a liquid outlet fitting opening out therein, said liquid inlet and outlet fittings being integrally molded with the water box, the water box and expansion chamber device including the improvement whereby the liquid inlet fitting is substantially adjacent to said internal partition in the water box and also to the expansion chamber, and whereby a liquid degassing passage is provided which comprises an orifice formed through a wall separating the water box and the expansion chamber, said orifice opening directly into the liquid inlet fitting and also into the expansion chamber below the level of the liquid normally contained therein.

The water box of a device in accordance with the invention is thus formed directly with a liquid inlet fitting which opens out into the middle thereof immediately above the internal partition, rather than into the top thereof, and this makes it possible to associate the liquid inlet fitting with a degassing passage constituted by a simple orifice through the wall separating the water box or the liquid inlet fitting from the expansion chamber.

This orifice opens out directly into the expansion chamber below the level of the liquid which it normally contains, thereby preventing air or gas being sucked back into the cooling circuit.

Preferably, the expansion chamber includes an internal tubular rim level with said orifice, said rim being directed towards the top end of the expansion chamber in order to guide bubbles of air or gas leaving from said orifice.

Advantageously, an additional orifice is formed through the wall separating the expansion chamber from the water box, said additional orifice opening out into the water box immediately below the internal partition therein, and likewise forming a liquid degassing passage.

Under some circumstances, the first orifice does not provide complete degassing. When this happens, bubbles of air or gas conveyed by the liquid flow through the heat exchanger and collect in the bottom compartment of the water box beneath the internal partition. The additional orifice enables these bubbles of air or gas to reach the expansion chamber.

BRIEF DESCRIPTION OF THE DRAWING

An embodiment of the invention is described by way of example with reference to the accompanying drawing, in which.

MORE DETAILED DESCRIPTION

Figure 1:
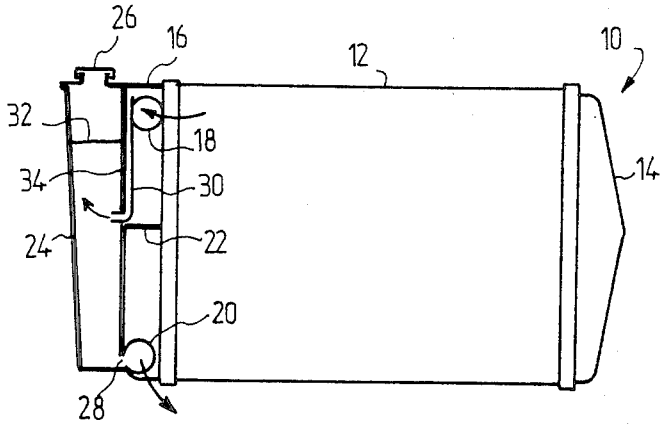
FIG. 1 PRIOR ART
FIG. 1 is a diagrammatic partial section through a prior art heat exchanger.

Reference is made initially to FIG. 1 which shows a conventional heat exchanger for constituting a radiator in a cooling circuit of a motor vehicle internal combustion engine.

In conventional manner, the heat exchanger 10 comprises a bundle 12 of horizontal liquid flow tubes with the ends of the tubes being mounted in two water boxes 14 and 16. The top of the water box 16 includes a liquid inlet fitting 18 for admitting liquid into the heat exchanger, and the bottom of the water box 16 includes a liquid outlet fitting 20. A middle partition 22 divides the internal volume of the water box 16 into two compartments which are sealed from each other where the water box 16 is mounted on the end of the bundle of tubes 12.

The water box 16 is integrally molded with an expansion chamber 24 which is disposed adjacent to the water box 16, and which is disposed generally vertically, as are the water boxes 14 and 16. The top of the expansion chamber 24 includes a filling orifice or fitting which is closed by a stopper 26 including conventional over- and under-pressure release valves. The bottom end of the expansion chamber 24 is in communication with the bottom end of the water box 16 or with the outlet fitting 20 via an orifice or duct 28 for returning liquid to the cooling circuit.

A small tube 30 is fixed inside the water box 16 to connect the top portion thereof with the expansion chamber 24. The bottom end of the tube 30 extends below the level 32 of liquid which is normally contained in the expansion chamber 24 and enters into the expansion chamber via an orifice through the wall 34 which separates the expansion chamber from the water box.

In operation, when the cooling liquid flows through the heat exchanger and is admitted into the water box 16 via the inlet fitting 18, bubbles of air or gas conveyed by the cooling liquid tend to collect in the top of the water box 16. These bubbles of air or gas are sucked through the tube 30 into the expansion chamber 24 by virtue of the relatively lower pressure in the expansion chamber. The bubbles leave the bottom end of the tube 30 and rise to the level 32 of the liquid contained in the expansion chamber 24.

Figure 2:
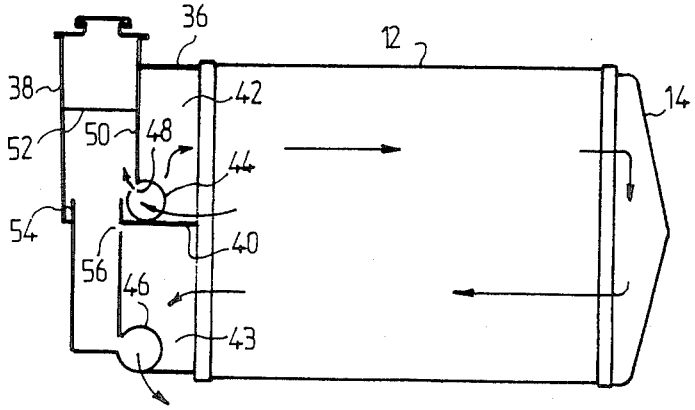
FIG. 2 is a similar view to FIG. 1 showing the same heat exchanger but fitted with a water box and expansion chamber device in accordance with the present invention.

In order to avoid the drawbacks related to placing the tube 30 in the water box 16 and to fixing it in place, the invention provides, as shown in FIG. 2, for the water box to be formed with a liquid inlet fitting which opens out substantially into the middle of the water box rather than into the top thereof.

In FIG. 2, the water box 36 is integrally molded wtih the expansion chamber 38 and includes a middle partition 40 which separates it into a top compartment 42 and a bottom compartment 43. The inlet fitting 44 for admitting liquid into the radiator opens out into the top compartment 42 of the water box 36, but just above the middle partition 40, while the liquid outlet fitting 46 is located at the bottom of the water box in conventional manner.

A liquid degassing passage comprises an orifice 48 formed through a wall 50 separating the expansion chamber 38 from the inlet fitting 44 for the top compartment 42 of the water box, with said orifice 48 directly connecting the expansion chamber 38 to the inlet fitting 44 and necessarily opening out below the level 52 of the liquid normally contained in the expansion chamber.

The expansion chamber may be formed with an internal tubular rim 54 immediately below the orifice 48 with the rim 54 being oriented towards the top of the expansion chamber in order to upwardly guide bubbles of air or gas leaving the orifice 48.

In conventional manner, the bottom end of the expansion chamber communicates with the bottom end of the water box 36 or with the outlet fitting 46.

In order to improve degassing, an orifice 56 may be formed through the wall separating the expansion chamber 38 from the bottom compartment 43 of the water box, immediately below the middle partition 40.

In operation, the cooling liquid enters the water box 36 via the inlet fitting 44. Bubbles of air or gas conveyed by said liquid are sucked into the expansion chamber 38 via the orifice 48. The liquid flows through the bundle of tubes 12 and into the other water box 14 as indicated by the arrow, and then returns to the bottom compartment 43 of the water box 36 whence it leaves via the outlet fitting 46. If the liquid still contains bubbles of air or gas, these tend to collect at the top of the bottom compartment 43 underneath the partition 40 from which they are sucked into the expansion chamber 38 via the orifice 56.

This provides excellent degassing of the liquid flowing through the heat exchanger.

Figure 3:
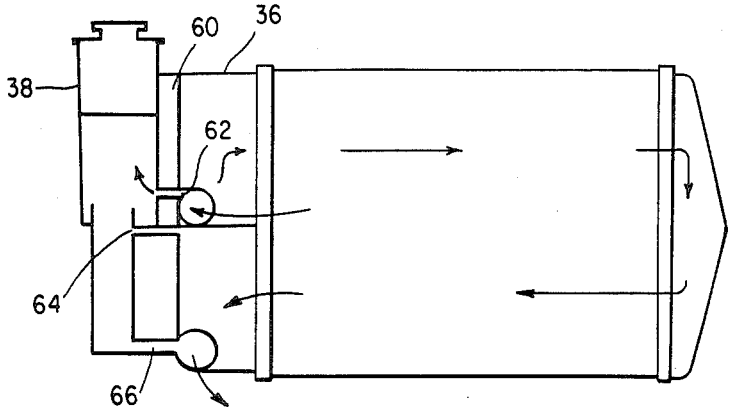
FIG. 3 is a similar view to FIG. 2 showing a variation.

In some cases, noting FIG. 3, the water box 36 and the expansion chamber 38 which are integrally molded as a single part are not immediately adjacent to each other but are a small distance apart with a web 60 therebetween, and therefore they do not have a common wall through which the orifices 48 and 56 can be formed. An example of such a construction will be noted in U.S. Pat. No. 4,492,267, issued Jan. 8, 1985 to Patrick Cadars. In this case, these orifices are replaced by small horizontal ducts 62, 64 and 66 which are molded with the water box and the expansion chamber at the same levels as the orifices 48 and 56 of FIG. 2 and the orifice 28 of FIG. 1. The ducts are easily unmolded via the open face of the water box. This is a simple equivalent which will readily be understood by the person skilled in the art.

What is claimed:

1. A water box and expansion chamber device for a heat exchanger, such as a radiator in a cooling circuit for an internal combustion engine, in which the water box and the expansion chamber constitute a one-piece molded assembly, with the water box being disposed in a generally vertical position and including an internal partition dividing it into a top compartment and a bottom compartment, the top compartment having a liquid inlet fitting opening out therein and the bottom compartment having a liquid outlet fitting opening out therein, said liquid inlet and outlet fittings being integrally molded with the water box, the water box and expansion chamber device including the improvement whereby the liquid inlet fitting is substantially adjacent to said internal partition in the water box and also to the expansion chamber, and a liquid degassing passage integrally formed through a wall separating the water box and the expansion chamber and opening directly into the liquid inlet fitting and also into the expansion chamber below the level of the liquid normally contained therein.

2. A device according to claim 1, wherein the expansion chamber includes an internal tubular rim level with said degassing passage, said rim being oriented towards the top end of the expansion chamber to guide bubbles of air or gas upwardly.

3. A device according to claim 1, wherein an additional degassing passage is formed through the wall separating the expansion chamber and the water box, said additional degassing pasasge opening out into the water box immediately below the internal partition therein and likewise forming a liquid degassing passage.

4. A device according to claim 3, wherein the water box and the expansion chamber are spaced a small distance apart and integrally molded as a single part, and wherein each degassing passage comprises a duct integrally molded with the water box and the expansion chamber.

5. A device according to claim 1, wherein the water box and the expansion chamber are spaced a small distance apart and integrally molded as a single part, and wherein the degassing passage comprises a duct integrally molded with the water box and the expansion chamber.

6. A device according to claim 2, wherein the water box and the expansion chamber are spaced a small distance apart and integrally molded as a single part, and wherein the degassing passage comprises a duct integrally molded with the water box and the expansion chamber.

7. A device according to claim 1 wherein said degassing passage comprises an orifice.

* * * * *